US009433265B2

(12) United States Patent
Chang et al.

(10) Patent No.: US 9,433,265 B2
(45) Date of Patent: Sep. 6, 2016

(54) BRACELET AND DETECTING DEVICE USING THE SAME

(71) Applicant: Chiun Mai Communication Systems, Inc., New Taipei (TW)

(72) Inventors: Ming-Shiung Chang, New Taipei (TW); Shu-Chen Chuang, New Taipei (TW); Chia-Hsin Chang, New Taipei (TW); Hsin-Wei Wang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 234 days.

(21) Appl. No.: 14/066,871

(22) Filed: Oct. 30, 2013

(65) Prior Publication Data

US 2014/0298857 A1 Oct. 9, 2014

(30) Foreign Application Priority Data

Apr. 8, 2013 (TW) ..... 102206259 U

(51) Int. Cl.
*A44C 5/00* (2006.01)

(52) U.S. Cl.
CPC ..... *A44C 5/0015* (2013.01)

(58) Field of Classification Search
None
See application file for complete search history.

(56) References Cited

U.S. PATENT DOCUMENTS 2,563,818 A * 8/1951 Clendening ..... A44C 5/0023 63/3
2012/0201104 A1* 8/2012 Amenduni Gresele ..... A44C 5/0015 368/239

* cited by examiner

*Primary Examiner* — Jack W Lavinder
(74) *Attorney, Agent, or Firm* — Zhigang Ma

(57) ABSTRACT

A wrist-worn bracelet displaying health indicators constructed to ensure correct and optimal fitting on a wrist of user for the effective detection of functioning of human body. The wrist-worn bracelet includes a first wristband portion and a second wristband portion connected to the first wristband portion to form a closed loop. The second wristband portion includes at least one inwardly-bent portion. A contour of the at least one inwardly-bent portion is capable of being changed by heating and bending the inwardly-bent portion so that an inner diameter of the closed loop is adjustable.

9 Claims, 3 Drawing Sheets

BRACELET AND DETECTING DEVICE USING THE SAME

BACKGROUND

1. Technical Field

The disclosure generally relates to detecting devices, and particularly to a bracelet having a flexible closed loop and a detecting device using the bracelet.

2. Description of Related Art

Bracelets incorporating electric conductors such as health detecting devices are well known. To detect health indicators (e.g. a pulses rate) of a user, most bracelets are closed loops made of rubber so that the health detecting device can make close contact with the user when the user wears the bracelet. The user commonly wears the bracelet by directly wrapping the bracelet around a wrist of the user or by disconnecting two attracting magnets of the bracelet. However, the bracelet has a fixed size, the size of which may not fit the wrist of the user. When the size of the bracelet is too small for the user, it is inconvenient/uncomfortable for a user to wear. When the size of the bracelet is too large for the user, the detecting device may not make correct contact with the wrist, which negatively affects a detecting of readings.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
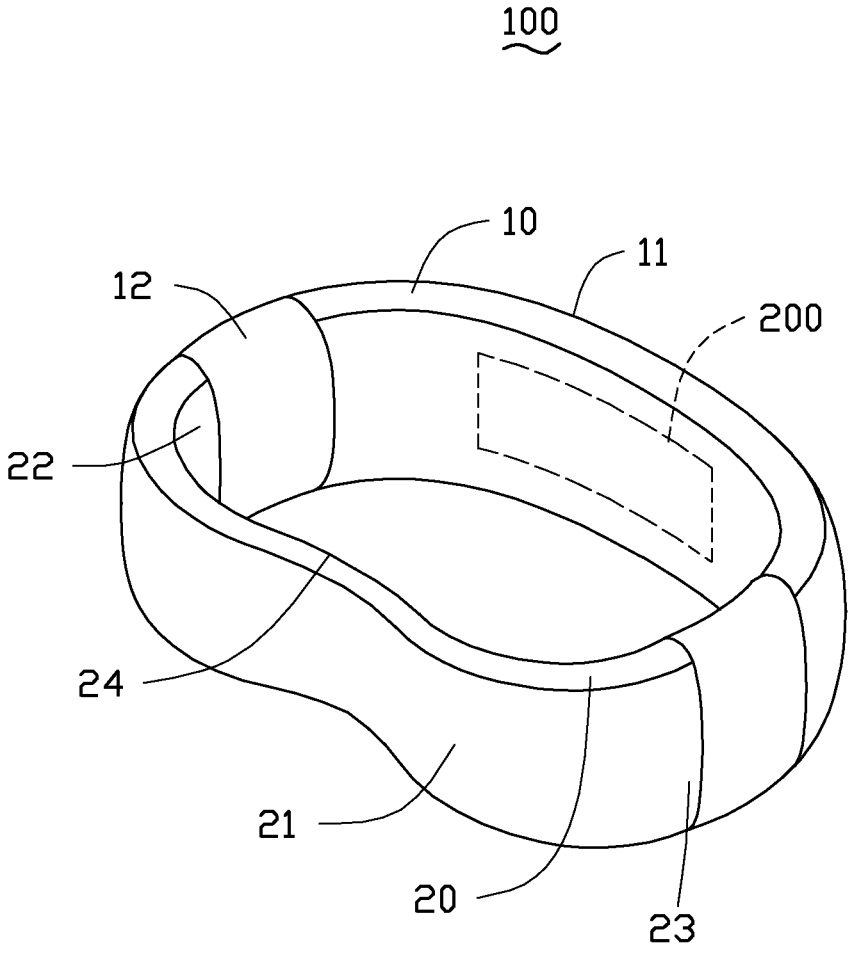
FIG. 1 is a schematic view of a bracelet and a detecting device using the bracelet, according to an exemplary embodiment of the disclosure.
Figure 3:
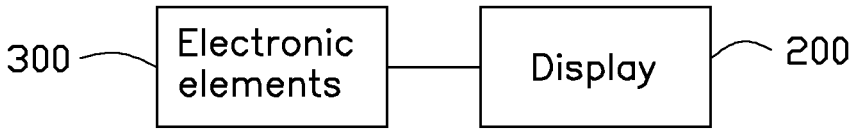
FIG. 3 is a schematic view of electronic elements and a display, according to an exemplary embodiment of the disclosure.

FIG. 1 is a schematic view of a bracelet 100 and a detecting device (not labeled) using the bracelet 100, according to an exemplary embodiment of the disclosure. The detecting device further includes a plurality of electronic elements 300 (schematically shown in FIG. 3) incorporated into the bracelet 100, configured to support conventional health detecting functions, and a display 200 positioned on the bracelet 100 and connected to the electronic elements 300, to display a result of health detection.

Figure 2:
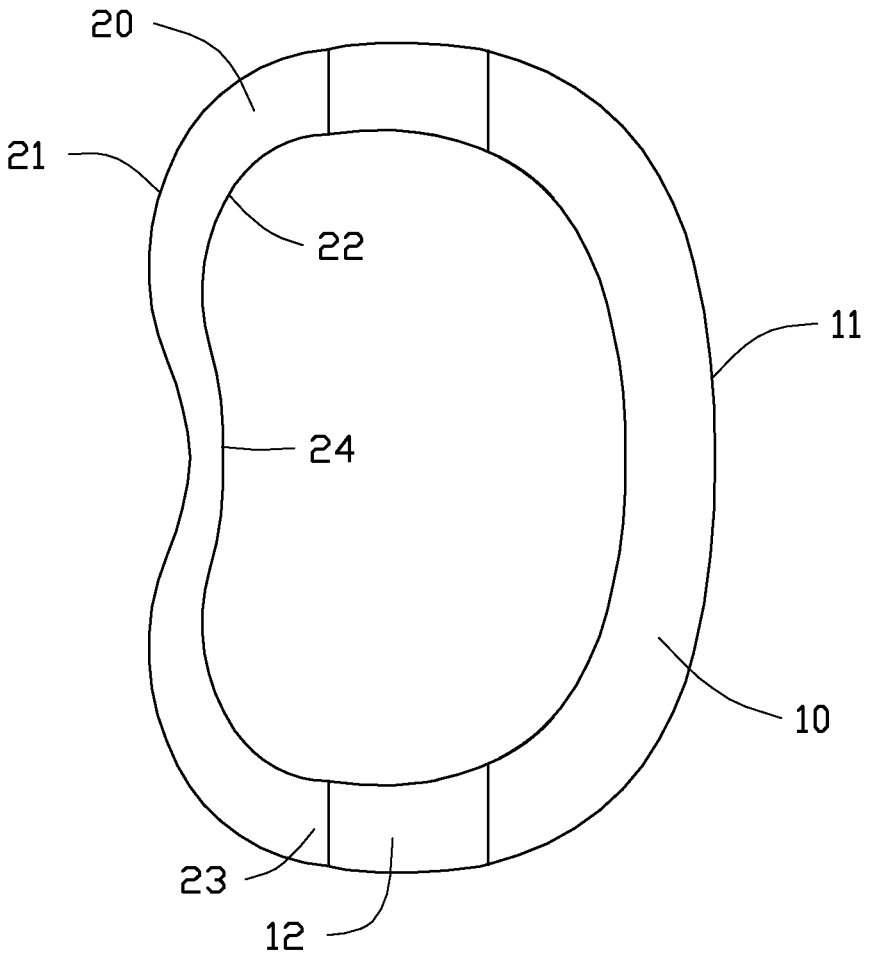
FIG. 2 is similar to FIG. 1, but showing the bracelet and the detecting device from another aspect.

Referring to FIG. 2, the bracelet 100 includes a first wristband portion 10 and a second wristband portion 20 connected to the first wristband portion 10.

The first wristband portion 10 is substantially a half-elliptic band including a first outer surface 11 and two opposite first connecting ends 12. The electronic members are embedded into the first wristband portion 10. The display 200 is positioned on the first outer surface 11. For convenient assembly of the electronic members into the first wristband portion 10, the first wristband portion 10 can be formed by two covers latched together, with a receiving space therein to receive the electronic members.

The second wristband portion 20 is substantially a wave-shaped band and includes a second outer surface 21, an inner surface 22 opposite to the first outer surface 21, two opposite second connecting ends 23, and at least one inwardly-bent portion 24. The two second connecting ends 23 are connected to the first connecting ends 12 with the inner surface 22 facing the first wristband portion 10 to form overall a substantially elliptic and closed loop. In this embodiment, the number of the inwardly-bent portions 24 is one. The inwardly-bent portion 24 is a protrusion formed by bending a middle portion of the second wristband portion 20 from the second outer surface 21 toward the inner surface 22.

The first wristband portion 10 and the second wristband portion 20 are formed by two-shot molding. In this embodiment, the second wristband portion 20 is made of thermoplastic polyurethane (TPU). To manufacture the second wristband portion 20, an arcuate band is formed of TPU, and then heated and bent to form the inwardly-bent portion 24. A molding temperature of the TPU band is relatively low. The contours of the inwardly-bent portion 24 can be adjusted to change an inner diameter of the bracelet (i.e. a distance between the inwardly-bent portion 24 and the first wrist band portion 10) by heating and bending the inwardly-bent portion 24 so that the size of the bracelet 100 can be adjusted to precisely fit the wrist of the user so the first wristband portion 10 can always make full and correct contact with the wrist of the user.

In another embodiment, the second connecting ends 23 can be connected to the first connecting ends 12 by a conventional latching structure.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A bracelet, comprising:

a first wristband portion arranging a display in a middle portion; and a second wristband portion connected to the first wristband portion to form a closed loop, the second wristband portion comprising at least one inwardly-bent portion, a contour of the at least one inwardly-bent portion is capable of changing by heating and bending the inwardly-bent portion so that an inner diameter of the closed loop is adjustable, the at least one inwardly-bent portion bending a middle portion of the second wristband portion towards the first wristband portion and aligned with the display;

wherein the first wristband portion comprises two opposite first connecting ends, the second wristband portion comprises two opposite second connecting ends corresponding to the first connecting ends, the first connecting ends are connected to the second connecting ends, respectively, to form overall an elliptic and closed loop.

2. The bracelet of claim 1, wherein the second wristband comprises an outer surface and an inner surface opposite to the outer surface, the at least one inwardly-bent portion is bending from the second outer surface toward the inner surface.

3. The bracelet of claim 1, wherein the second wristband portion is made of thermoplastic polyurethane.

4. A bracelet, comprising:

a first wristband portion arranging a display in a middle portion; and a second wristband portion connected to the first wristband portion to form a closed loop, the second wristband portion comprising at least one inwardly-bent portion, a distance between the at least one inwardly-bent portion and the first wristband portion is changeable by heating and bending the inwardly-bent portion, the at least one inwardly-bent portion bending a middle portion of the second wristband portion towards the first wristband portion and aligned with the display;

wherein the first wristband portion comprises two opposite first connecting ends, the second wristband portion comprises two opposite second connecting ends corresponding to the first connecting ends, the first connecting ends are connected to the second connecting ends, respectively, to form overall an elliptic and closed loop.

5. The bracelet of claim 4, wherein the second wristband comprises an outer surface and an inner surface opposite to the outer surface, the at least one inwardly-bent portion is bending from the second outer surface toward the inner surface.

6. The bracelet of claim 4, wherein the second wristband portion is made of thermoplastic polyurethane.

7. A detecting device, comprising:

a display;

a bracelet comprising:

a first wristband portion, the display positioned on a middle portion of an outer surface of the first wristband portion; and a second wristband portion connected to the first wristband portion to form a closed loop, the second wristband portion comprising at least one inwardly-bent portion, a contour of the at least one inwardly-bent portion is capable of changing by heating and bending the inwardly-bent portion so that an inner diameter of the loop is adjustable, the at least one inwardly-bent portion bending a middle portion of the second wristband portion towards the first wristband portion and aligned with the display;

wherein the first wristband portion comprises two opposite first connecting ends, the second wristband portion comprises two opposite second connecting ends corresponding to the first connecting ends, the first connecting ends are connected to the second connecting ends, respectively, to form overall an elliptic and closed loop.

8. The detecting device of claim 7, wherein the second wristband comprises an outer surface and an inner surface opposite to the outer surface, the at least one inwardly-bent portion is bending from the second outer surface toward the inner surface.

9. The detecting device of claim 7, wherein the second wristband portion is made of thermoplastic polyurethane.

* * * * *